US005435077A

United States Patent [19]

Pyle

[11] Patent Number: 5,435,077

[45] Date of Patent: Jul. 25, 1995

[54] LAYERED CUSHIONING SYSTEM FOR SHOE SOLES

[75] Inventor: Clifford L. Pyle, Cincinnati, Ohio

[73] Assignee: The United States Shoe Corporation, Cincinnati, Ohio

[21] Appl. No.: 229,309

[22] Filed: Apr. 18, 1994

[51] Int. Cl.[6] ..... A43B 13/18; A43B 13/16; A43B 13/00

[52] U.S. Cl. ..... 36/28; 36/30 R; 36/30 A; 36/37; 36/43; 36/76 R; 36/76 C

[58] Field of Search ..... 36/25 R, 28, 29, 30 R, 36/30 A, 35 R, 37, 43, 44, 71, 76 R, 76 C

[56] References Cited

U.S. PATENT DOCUMENTS

| | | | |
|---|---|---|---|
| 1,853,027 | 4/1932 | Adams | 36/37 |
| 1,919,862 | 7/1933 | Rohn et al. | 36/37 |
| 1,942,001 | 1/1934 | Rohn et al. | 36/37 |
| 1,973,105 | 9/1934 | Rohn et al. | 36/35 R |
| 2,089,170 | 8/1937 | Bain | 36/28 |
| 2,126,601 | 8/1938 | Bain | 36/28 |
| 2,175,687 | 10/1939 | Everston | 36/37 |
| 2,348,336 | 5/1944 | Everston . | |
| 2,385,690 | 9/1945 | Codish | 36/30 R |
| 2,995,840 | 8/1961 | Greenbaum | 36/19.5 |
| 3,302,312 | 2/1967 | Hartley | 36/76 R |
| 3,724,104 | 4/1973 | Eder et al. | 36/32 R |
| 3,766,669 | 10/1973 | Pearsall . | |
| 3,971,145 | 7/1976 | Stegerwald . | |
| 4,128,950 | 12/1978 | Bowerman et al. . | |
| 4,182,055 | 1/1980 | Turner, Jr. | 36/30 R |
| 4,316,332 | 2/1982 | Giese et al. . | |
| 4,316,335 | 2/1982 | Giese et al. . | |
| 4,361,912 | 12/1982 | Arthur | 36/106 |
| 4,398,357 | 8/1983 | Batra . | |
| 4,399,620 | 8/1983 | Funck . | |
| 4,404,702 | 9/1983 | Clayman et al. | 36/76 C |
| 4,463,505 | 8/1984 | Duclos . | |
| 4,481,726 | 11/1984 | Phillips . | |
| 4,519,147 | 5/1985 | Jones, Jr. | 36/30 A |
| 4,551,930 | 11/1985 | Graham et al. . | |
| 4,564,966 | 1/1986 | Chen . | |
| 4,641,438 | 2/1987 | Laird et al. . | |
| 4,667,423 | 5/1987 | Autry et al. . | |
| 4,676,010 | 6/1987 | Cheskin . | |
| 4,757,620 | 7/1988 | Tiitola . | |
| 4,760,652 | 8/1988 | Austin . | |
| 5,025,573 | 6/1991 | Giese et al. . | |
| 5,101,580 | 4/1992 | Lyden | 36/28 |
| 5,163,237 | 11/1992 | Rosen . | |
| 5,174,049 | 12/1992 | Flemming . | |
| 5,311,677 | 5/1994 | Mann et al. | 36/35 R |

*Primary Examiner*—Paul T. Sewell
*Assistant Examiner*—Marie Denise Patterson
*Attorney, Agent, or Firm*—Laubscher & Laubscher

[57] ABSTRACT

A layered cushioning system for a shoe sole for women's pumps is characterized by a flexible polyurethane outsole containing a recess in the upper forepart thereof within which is molded a shock-absorbing foam insert. A rigid insole tuck having a steel shank and a contoured configuration is mounted on the outsole and extends from the heel to the arch. A shock-absorbing heel pad is connected with the upper surface of the tuck in the heel area. Mounted on the insole tuck is a socklining including a lower shock-absorbing foam layer and a urethane coated cover. A further shock absorbing foam insole is provided for the forepart area. The sole thus has superior cushioning, flexibility in the forepart region and stability in the rear.

7 Claims, 3 Drawing Sheets

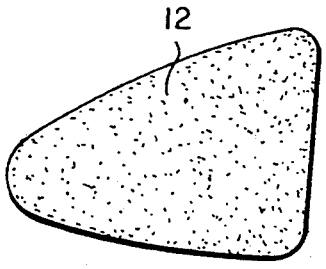
FIG. 7
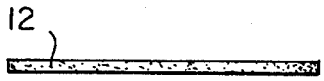
FIG. 8
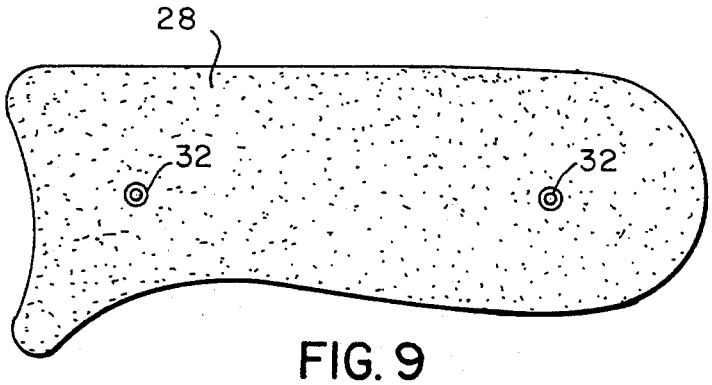
FIG. 9
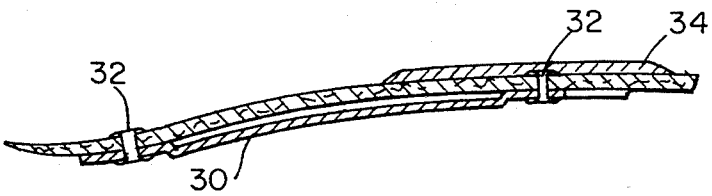
FIG. 10
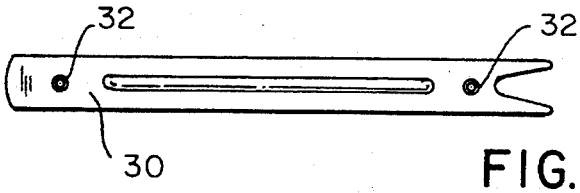
FIG. 11
FIG. 12
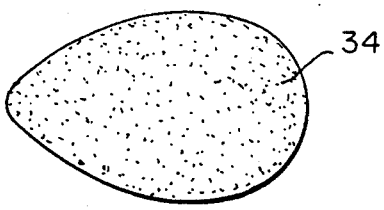

FIG. 13
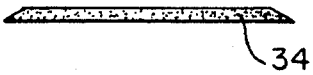
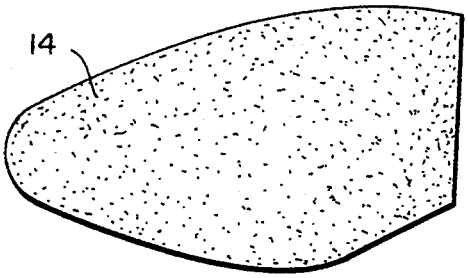
FIG. 14
FIG. 15
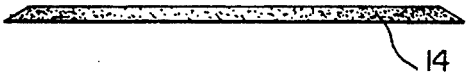
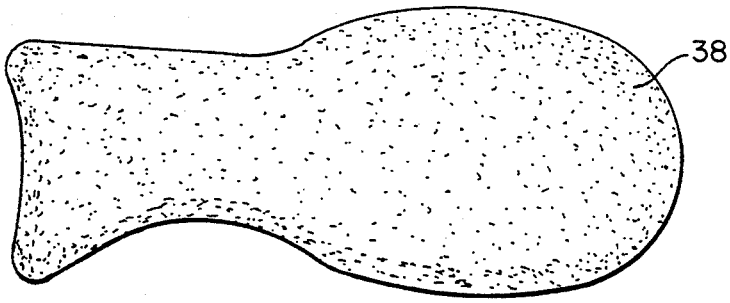
FIG. 16
FIG. 17
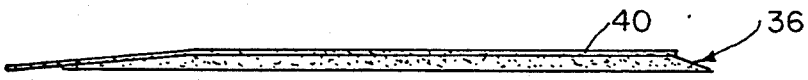
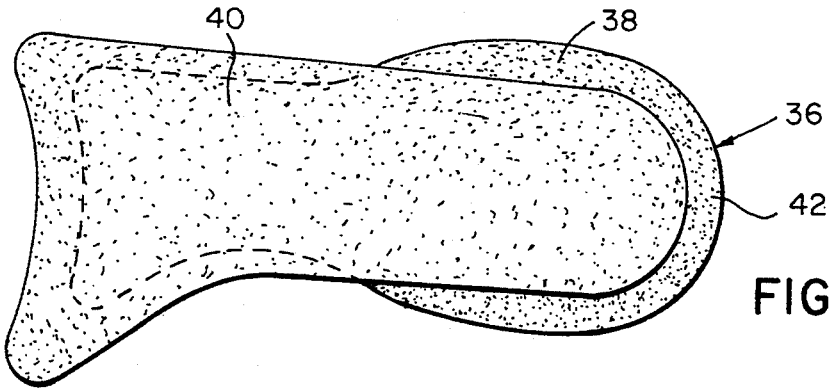
FIG. 18

LAYERED CUSHIONING SYSTEM FOR SHOE SOLES

BACKGROUND OF THE INVENTION

Women have long suffered from uncomfortable dress shoes. In order to incorporate stylish features in the shoes, it has been necessary to construct the shoes of rigid durable materials to provide a high degree of support with a minimal amount of material. Recent developments in outsole materials and shock absorbing foam materials have been incorporated into athletic footwear but not in dress shoes such as pumps because of the difficulties in providing such features in a shoe which is still stylish for dress wear or street wear.

BRIEF DESCRIPTION OF THE PRIOR ART

One way of improving the comfort of footwear is to use flexible outsoles and layered socklinings as the sole construction for footwear. For example, the U.S. patents to Austin U.S. Pat. No. 4,760,652 and Cheskin U.S. Pat. No. 4,676,010 disclose composite outsoles which are flexible and resilient and thus suitable for use with athletic footwear. A major drawback of these prior composite outsoles is that they lack rigidity and durability necessary for streetwear.

Efforts to improve the comfort of footwear include providing padded soles as shown in the Funck U.S. Pat. No. 4,399,620. Unfortunately, as a result of extended use, the padding of the sole becomes permanently compressed by the weight of the wearer so that the cushioning properties of the foam diminish over time. This is particularly true in the heel area of the shoe sole.

The present invention was developed in order to overcome these and other drawbacks of the prior sole constructions by providing a layered cushioning system and flexible outsole for women's dress shoes, and particularly pumps.

SUMMARY OF THE INVENTION

Accordingly, it is a primary object of the invention to provide a layered cushioning system for a shoe sole, and particularly a shoe sole for a woman's pump, including a flexible outsole containing a recess in an upper surface of the forepart portion and a shock-absorbing foam insert molded within the recess. A rigid contoured insole tuck is mounted on the outsole and extends from the heel to the arch. On the upper surface of the heel portion of the tuck is fastened a heel pad of shock-absorbing foam. A socklining including a flexible cover layer and a lower layer of shock-absorbing foam is mounted on the heel tuck and terminates short of the outsole forepart portion.

According to a further object of the invention, an insole is provided within an upper of the shoe. The insole is formed of a shock-absorbing foam and is mounted on the forepart portion of the outsole. The insole further includes an upper leather layer and a lower cloth layer.

In order to increase the rigidity of the insole tuck, a rigid contoured steel rod is connected with the lower surface of the tuck and extends between the heel and arch portions thereof.

According to another object of the invention, the foam used for the insert, the heel pad, the socklining foam layer, and the insole is a closed cell vinyl nitrile foam material which resists permanent compression. The outsole is formed from a polyurethane material which is highly flexible, yet durable enough for street wear. It contains a plurality of spaced ribs in a lower surface of the forepart for increased traction.

BRIEF DESCRIPTION OF THE FIGURES

Other objects and advantages of the invention will become apparent from a study of the following specification when viewed in the light of the accompanying drawing, in which:

FIGS. 7 and 8 are top and side views, respectively, of a foam insert for the outsole;

FIG. 9 is a top view of the heel tuck of the invention;

FIG. 10 is a longitudinal sectional view of the heel tuck with the steel rod and heel pad connected therewith;

FIG. 11 is a plan view of the steel rod;

FIGS. 12 and 13 are top and side views, respectively, of the heel pad;

FIGS. 14 and 15 are top and side views, respectively, of the foam insole;

FIG. 16 is a top plan view of the foam layer of the socklining; and

FIGS. 17 and 18 are side and top views, respectively, of the socklining showing the cover and foam layers.

DETAILED DESCRIPTION

Figure 1:
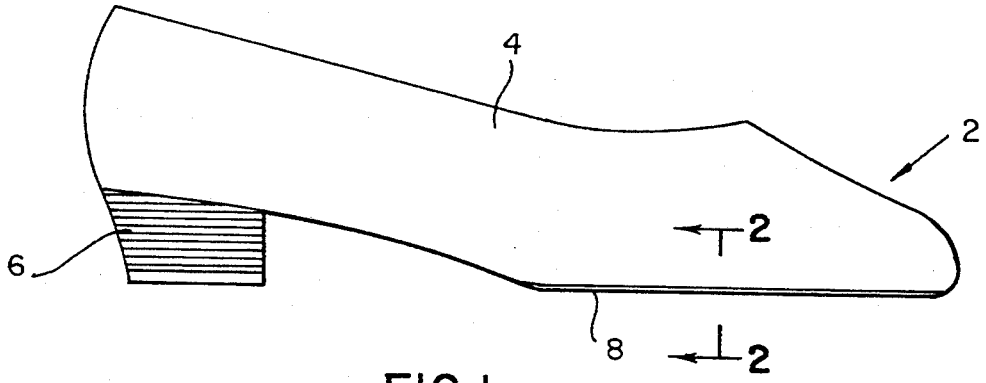
FIG. 1 is a side plan view of a woman's pump incorporating the layered cushioning system for the sole thereof according to the invention.

There is shown in FIG. 1 an article of footwear such as a women's pump 2 including an upper 4, a heel 6, and the sole construction 8 of the invention. The upper 4 is conventional and comprises a soft and supple nappa kidskin leather for a tailored look and comfort for the wearer.

Figure 2:
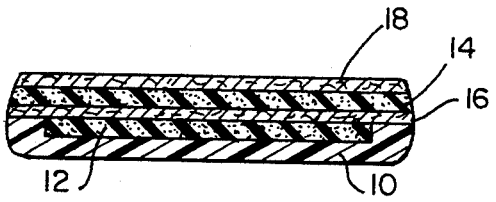
FIG. 2 is a cross-section of the cushioning system and sole taken along line 2—2 of FIG. 1.

The sole construction is characterized by a four layer cushioning system in the forepart of the shoe. Referring to FIG. 2, the four layers include a lower outsole 10, a foam insert 12, a foam insole 14 (having a lower cloth layer 16), and a leather cover layer 18. These elements will be described in more detail below.

Figure 3:
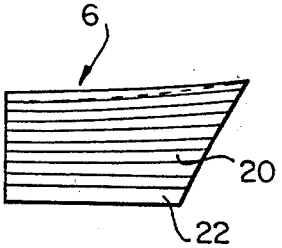
FIG. 3 is a side view of the heel.

The heel 6 which is shown in FIG. 3 is formed of a rigid synthetic plastic material. Around the periphery of the heel is a veneer 20 resembling stacked leather layers for asthetic purposes. At the bottom of the heel is a synthetic plastic base 22 which preferably has a ribbed bottom for traction. The heel is strong and durable for withstanding the friction and abrasions resulting from use on the street.

The outsole 10 will be described with reference to FIGS. 4–6. It is formed of a flexible low density polyurethane material and includes forepart **10*a*, arch 10*b*, and heel 10*c* portions, the heel portion being stapled to the top surface of the heel 6. It is not necessary that the outsole heel portion completely cover the heel 6** and in fact it normally does not which affords a high degree of tolerance during the construction process.

Figure 5:
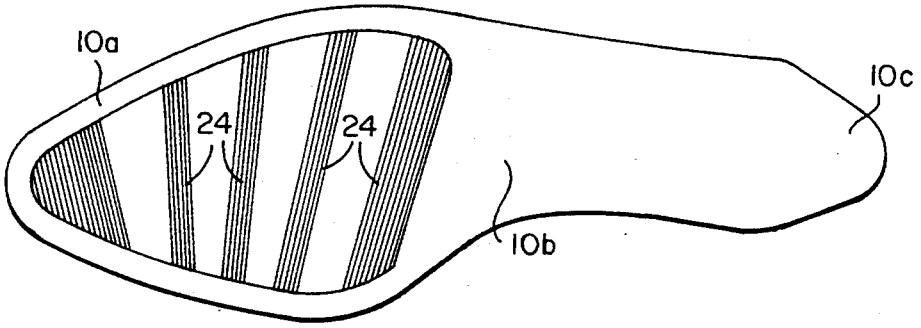
Figure 6:
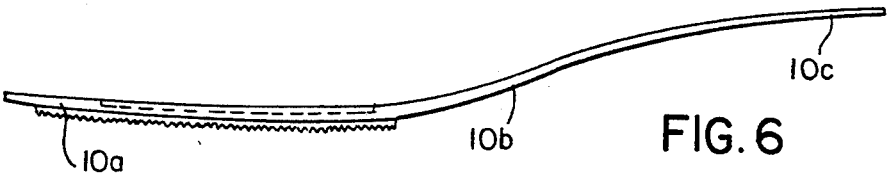

As shown in FIG. 5, the bottom surface of the forepart portion **10*a* of the outsole contains a plurality of spaced ribs 24** which provide traction for the wearer during walking.

Figure 4:
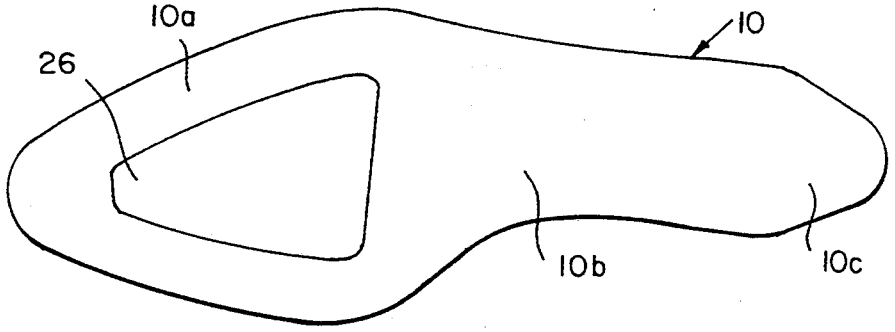
FIGS. 4–6 are top, bottom, and side views, respectively, of the outsole of the invention.

The upper surface of the forepart portion 10*a* of the outsole contains a recess 26 as shown in FIG. 4. Within the recess is molded the insert 12 which as shown in FIGS. 7 and 8 has a configuration matching that of the recess. The insert 12 is formed of a shock absorbing foam material such as closed cell vinyl nitrile foam which resists permanent compression. Such a foam material is compressible but returns to its natural configuration when pressure, such as from the weight of the wearer, is removed. Thus, the foam conforms somewhat to the wearer's foot during use but resumes its regular state when not in use.

While the forepart portion of the outsole is extremely flexible, it is necessary to provide some rigidity in the heel and arch portions of the sole to provide structural stability and support to the shoe owing to the rise provided by the heel. To provide this stability, a rigid insole tuck 28 is provided. The tuck is shown in FIGS. 9 and 10 and includes heel and arch portions but not a forepart portion. It is mounted on the upper surface of the outsole over the heel and arch portions thereof. The tuck is preferably formed from a compressed fiberboard which is relatively light in weight and it is skived, beveled, and molded to the shape of the shoe last used in the shoe construction. To increase the longitudinal rigidity of the tuck, a steel rod or shank 30 is secured to the lower surface of the tuck by rivets 32. The shank is shown in plan view in FIG. 11.

In order to cushion the heel of the wearer's foot, a heel pad 34 of shock-absorbing foam is connected with the upper surface of the insole tuck as shown in FIG. 10. Any suitable adhesive can be used to connect the pad with the tuck. Referring to FIGS. 12 and 13, the heel pad has an oblong or egg-shaped configuration, with the rounded edge being oriented toward the rear of the insole tuck. The edges of the heel pad are also tapered as shown in FIG. 13 for a smooth transition with the insole tuck. Like the insert 12, the shock-absorbing foam of the heel pad is a closed cell vinyl nitrile foam which resists permanent compression.

Further cushioning for the forepart portion of the wearer's foot is provided by the foam insole 14 of FIGS. 14 and 15, and additional cushioning for the heel and arch portions of the foot are provided by the socklining 36 shown in FIGS. 16–18.

The insole 14 of FIGS. 14 and 15 is formed of closed cell vinyl nitrile foam material which resists permanent compression. It is provided with a lower cloth layer 16 which is shown in FIG. 2 and is stitched as a part of the upper. That is, the leather of the upper covers the top of the insole and it is stitched around its edge. The leather layer further cushions the forepart of the wearer's foot. The insole thus functions essentially as a socklining, but it is limited to the forepart.

The socklining 36 of FIGS. 16–18 extends from the heel portion of the shoe to the forepart where it slightly overlaps the leather layer 18 of the insole. The overlapped area affords a natural point of flexure for the outsole between the forepart and arch portions thereof which greatly adds to the flexibility and comfort of the sole construction during walking.

The socklining 36 comprises two layers, a lower foam layer 38 and an upper cover layer 40. The foam layer 38 is a shock-absorbing foam material such as vinyl nitrile closed cell foam similar to that used for the insole, heel pad, and insert. The cover layer 40 includes a urethane coating for comfort and durability. As shown in FIG. 18, the foam layer includes a heel portion 42 which extends beyond the cover layer to provide added cushioning and support surrounding the heel.

The novel sole construction according to the invention thus provides separate cushioning elements for the forepart and arch and heel portions of the wearer's foot. The separate cushioning allows increased flexure of the outsole in the forepart, and the rigid insole tuck and shank provide stability and support for the rear of the shoe.

While in accordance with the provisions of the patent statute the preferred forms and embodiments have been illustrated and described, it will be apparent to those of ordinary skill in the art that various changes and modifications may be made without deviating from the inventive concepts set forth above.

What is claimed is:

1. A layered cushioning system for a shoe sole construction, comprising (a) a flexible outsole containing a recess in an upper surface of a forepart portion thereof;

(b) an insert formed of shock-absorbing foam material arranged within said outsole recess;

(c) a rigid insole tuck including a steel rod connected with a lower surface thereof, said tuck being mounted on said outsole, said tuck and said rod being contoured and extending over heel and arch portions of said outsole to provide arch support and stability in a heel area of the sole;

(d) a heel pad formed of shock-absorbing foam material connected with an upper surface of said tuck in a heel portion thereof;

(e) a socklining including a flexible cover layer and a lower layer of shock-absorbing foam, said socklining being mounted on said heel tuck and terminating short of said outsole forepart portion; and (f) a rigid heel connected with said outsole to define a sole construction for a pump.

2. A layered cushioning system as defined in claim 1, and further comprising an insole formed of shock absorbing foam material, said insole being formed within an upper of a shoe and being mounted on said forepart portion of said outsole.

3. A layered cushioning system as defined in claim 2, wherein said socklining foam layer extends beyond said flexible cover layer in the heel portion thereof.

4. A layered cushioning system as defined in claim 3, wherein said insert, said heel pad, said socklining foam layer, and said insole are formed from a closed cell vinyl nitrile foam material which resists permanent compression.

5. A layered cushioning system as defined in claim 4, wherein said outsole is formed of polyurethane material and includes a plurality of spaced ribs in a lower surface of the forepart thereof for increased traction.

6. A layered cushioning system as defined in claim 5, wherein said insole tuck is formed of compressed fiberboard.

7. A layered cushioning system as defined in claim 6, wherein said socklining cover layer is coated with urethane material.

* * * * *